United States Patent [19]

Adams et al.

[11] Patent Number: 4,901,940

[45] Date of Patent: Feb. 20, 1990

[54] PLASTIC YARN CONE HAVING REINFORCED NOSE FOR DAMAGE PROTECTION

[75] Inventors: Samuel F. Adams; Hans-Peter Bolz, both of Greenville, S.C.

[73] Assignee: Sonoco Products Company, Hartsville, S.C.

[21] Appl. No.: 369,004

[22] Filed: Jun. 20, 1989

[51] Int. Cl.[4] ..... B65H 75/10; B65H 75/18

[52] U.S. Cl. ..... 242/118.31; 242/118.32

[58] Field of Search ..... 242/118.31, 118.3, 118.32, 242/118, 118.1, 118.11, 118.2, 68, 68.5, 68.6; 138/172

[56] References Cited

U.S. PATENT DOCUMENTS

| | | | |
|---|---|---|---|
| 2,006,797 | 7/1935 | Dunlap | 242/118.32 |
| 3,004,730 | 10/1961 | Gray | 242/68.6 |
| 3,246,856 | 4/1966 | Winslow | 242/118.3 X |
| 3,454,235 | 7/1969 | Hurley | 242/118.3 |
| 3,532,291 | 10/1970 | Newman | 242/118.31 |
| 3,567,146 | 3/1971 | Arenson | 242/68.6 |
| 3,627,220 | 12/1971 | Vogel | 242/68.6 |
| 3,840,194 | 10/1974 | Vetter | 242/68.6 |
| 3,946,866 | 3/1976 | Turnage | 242/68.6 |
| 4,384,685 | 5/1983 | Pitts | 242/118.32 |
| 4,519,557 | 5/1985 | Newman | 242/118.31 |
| 4,742,972 | 5/1988 | Rost et al. | 242/118.31 |

FOREIGN PATENT DOCUMENTS

| | | | |
|---|---|---|---|
| 322580 | 12/1929 | United Kingdom | 242/118.32 |

*Primary Examiner*—Stanley N. Gilreath

*Attorney, Agent, or Firm*—Bell, Seltzer, Park & Gibson

[57] ABSTRACT

This invention relates to a lightweight plastic yarn carrier adapted to receive yarn wound thereon to form a yarn package. The yarn carrier is comprised of a hollow conical tube with a reinforced end portion at one end of the tube. The end is formed of an annular end wall extending radially in from the end of the tube and an annular flange extending inwardly toward the opposite end of the tube from the inner periphery of the end wall. The peripheral wall, end wall and annular flange collectively define an inside annular channel within the carrier. The reinforcement of the end portion is comprised of a plurality of circumferentially spaced apart ribs extending across the inside annular channel and at least one circumferential rim extending from the end wall and circumferentially around the inside annular channel to reinforce the end portion of the carrier. With this reinforcement arrangement, the end wall better resists impact on the end and further prevents the spread of damage that may be incurred.

14 Claims, 1 Drawing Sheet

PLASTIC YARN CONE HAVING REINFORCED NOSE FOR DAMAGE PROTECTION

FIELD OF THE INVENTION

This invention relates to yarn carriers for receiving yarn wound thereon and more particularly to lightweight tubular yarn carriers for supporting yarn packages.

BACKGROUND OF THE INVENTION

In conventional textile mills, yarn is typically stored and handled in yarn packages which are formed by a yarn wound about the exterior surface of a generally tubular plastic yarn carrier. The yarn carriers are preferably inexpensive, lightweight conical tubes with between about one and five inches in thickness of yarn wound thereabout. The wound yarn provides a shock absorbing or cushioned protective surface on the carrier, except for the end portions of the carrier which typically extend about ¼" to about ¾" from the ends of the wound yarn. The yarn packages are commonly subjected to rough handling in the textile mill, however, the carriers are not usually damaged because of the cushioning surface provided by the yarn.

However, a times, the end portions of the carrier may hit a hard object such as the bottom of a bin, a concrete floor, etc. with sufficient force to crack or chip the carrier. When the carrier is cracked or chipped the yarn may become snagged when being withdrawn from the carrier which may damage or break the yarn. This is a particular problem when the nose or smaller diameter end is broken because the yarn is removed from the nose end of the carrier and is more likely to come into contact with the broken portion. In some cases the degree of damage to the carrier may be significant and thereby render the entire package of yarn unusable.

Breakage of the yarn carriers is also more commonly associated with disposable or one-way yarn carriers. As opposed to yarn carriers which are used over and over and are accordingly designed for durability, yarn carriers which are disposed of after use are constructed as inexpensively as feasible. As such, it is typical for the disposable yarn carrier to have relatively thin walls and therefore be more susceptible to damage.

To protect the nose from damage, Turnage U.S. Pat. No. 3,946,866 shows a nose protector attached to the nose of the carrier. However, the required additional manufacturing step to fabricate and attach the protector to the carrier adds to the cost of the carrier.

Pitts U.S. Pat. No. 4,384,685 shows a bobbin with axial fins at the upper end to reinforce the end wall which receives a spindle shaft. The reinforcement is primarily to provide stability of the bobbin while attached to the spindle. Accordingly the end is heavily reinforced and provided with substantial material which adds to the cost of the carrier.

It is also known that a plastic conical carrier may be provided with radial ribs reinforcing a rolled nose at the small end thereof. However, any damage suffered by this type of carrier may spread along the carrier causing further damage and potential harm to the yarn.

Accordingly it is an object of the present invention to provide a yarn carrier that has a strengthened nose and avoids the drawbacks of the prior art as discussed above.

It is a more particular object of the present invention to provide an improved nose reinforcement structure for a yarn carrier and which provides for a compartmentalized containment of impact forces and a distribution thereof so as to prevent or minimize damage by splitting, chipping or cracking of the nose during operation and use of the carrier.

SUMMARY OF THE INVENTION

The above and other objects are achieved by the provision of a lightweight yarn carrier comprising a generally hollow tube having opposite ends and a relatively thin peripheral wall defining an outer surface for receiving yarn to be wound thereon. The yarn carrier further includes a relatively thin annular end wall extending radially inwardly from one of the ends of the peripheral wall. An annular flange extends from the inner periphery of the end wall toward the opposite end of the tube. The peripheral wall, the end wall and the inner flange collectively define an end portion of the carrier and an inside annular channel within the carrier between the inner surface of the peripheral wall and a generally opposed inner surface of the inner flange. The yarn carrier further includes a plurality of circumferentially spaced apart ribs extending across the inside annular channel and at least one circumferential rim extending circumferentially from the end wall around the annular channel and intersecting with each of said ribs to provide additional reinforcing strength for the end portion of the carrier. The yarn carrier therefore is relatively lightweight with a reinforced end portion to withstand a substantial impact and avoid cracking and chipping.

BRIEF DESCRIPTION OF THE DRAWINGS

Some of the features of the invention have been stated and others will appear as the description proceeds when taken in conjunction with the accompanying drawings in which.

DETAILED DESCRIPTION OF THE PREFERRED EMBODIMENT

Figure 4:
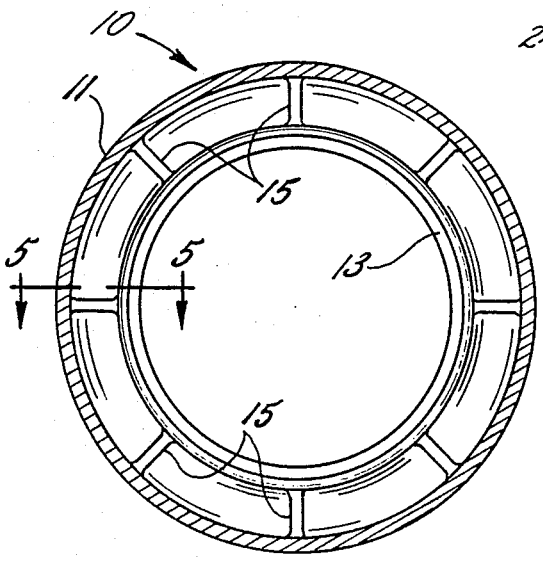
FIG. 4. (PRIOR ART)
FIG. 4 is a sectional view similar to FIG. 2 however showing a prior art yarn carrier.
Figure 5:
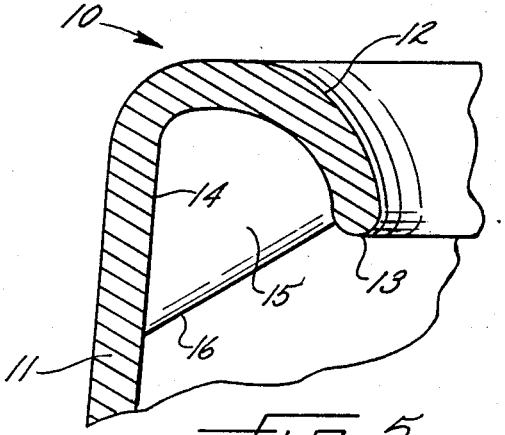
FIG. 5. (PRIOR ART)
FIG. 5 is a fragmentary sectional view taken along line 5—5 in FIG. 4.

Referring now more particularly to the drawings, FIGS. 4 and 5 illustrate a prior art yarn carrier generally indicated by the reference numeral 10 with a reinforced nose arrangement. The prior art yarn carrier 10 comprises a generally hollow tube formed by a peripheral wall 11. At one end of the peripheral wall 11 is a rolled or curved end 12 which terminates at an inner lip 13. The peripheral wall 11 and curved end 12 form an inside annular channel 14. A series of circumferentially spaced apart radial ribs 15 extend across the annular channel 14 to reinforce the end of the carrier 10. As is more clearly illustrated in FIG. 5, the ribs 15 extend the full depth of the annular channel 14. Moreover, each rib has an outer edge 16 which faces outwardly from the annular channel 14. The outer edge 16 extends from adjacent the inner lip 13 across the channel 14 angularly away from the end 12 to the peripheral wall 11 thereby extending essentially out of the annular channel.

Figure 1:
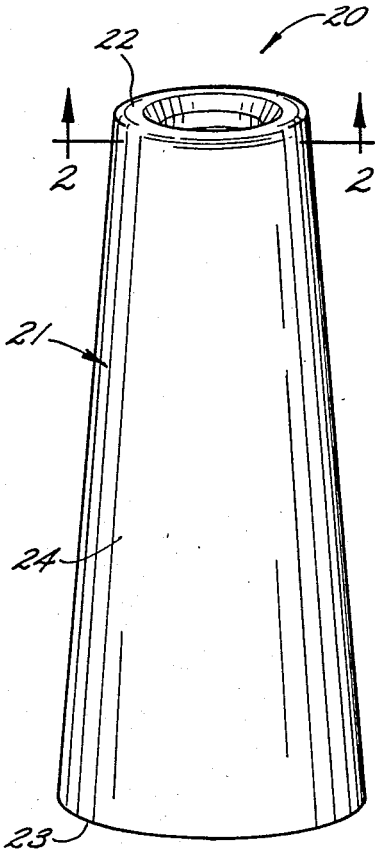
FIG. 1 is a top perspective view of a yarn carrier embodying the features of the present invention.
Figure 2:
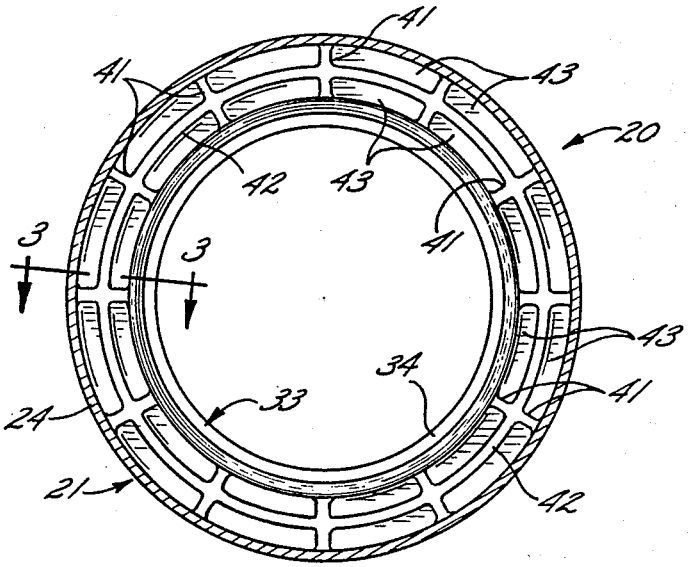
FIG. 2 is a sectional view of the yarn carrier taken along line 2—2 in FIG. 1.
Figure 3:
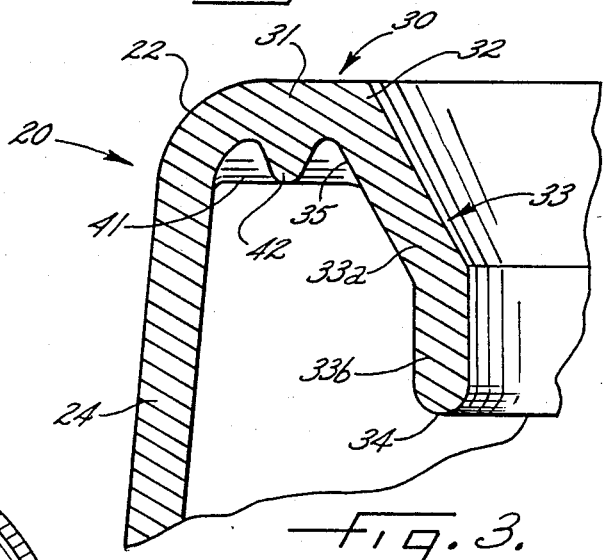
FIG. 3 is a fragmentary sectional view of the yarn carrier taken along line 3—3 in FIG. 2.

In contrast to the prior art yarn carrier 10, FIGS. 1, 2 and 3 illustrate a preferred embodiment of a yarn carrier embodying the features of the present invention and generally indicated by the reference numeral 20. The yarn carrier 20 is comprised of a hollow tube 21 with opposite open ends 22 and 23. The hollow tube 21 is illustrated in the form of a truncated cone although it may be cylindrical or have another conventional shape. The hollow tube 21 further includes a peripheral wall 24 which defines an outer surface of the carrier for receiving yarn wound thereon. Accordingly, the outer surface may be provided with a coarse or roughened texture to better facilitate winding of the yarn onto the carrier.

The yarn carrier 20 further includes a rounded or turned in end portion 30 at the smaller diameter end 22 which is sometimes referred to as the "nose" portion. The rounded or turned-in end portion 30 is more particularly illustrated in FIG. 3 wherein the end portion 30 is comprised of an annular end wall 31 extending radially inwardly from the small diameter end 22 of the peripheral wall 24. The annular end wall 31 has the shape of a generally flat disc with a large hole centrally positioned therein. The annular end wall 31 therefore terminates at an inner periphery 32 to form a generally circular opening in the end of the carrier 20. The rounded or turned-in end portion 30 further includes an annular flange 33 which extends inwardly of the tube 21 from the inner periphery 32 of the end wall 31 toward the opposite end 23 of the tube 21. The annular flange 33 has a rather complex shape which is comprised of a frusto-conical portion 33*a* adjacent the end wall 31 and a generally cylindrical inner end portion 33*b*. Accordingly, the end portion 30 is defined by the peripheral wall 24, the end wall 31 and the annular flange 33, collectively and which, in the sectional view of FIG. 3, forms an inverted "U" shape.

To prevent or limit the damage caused by rough handling, the yarn carrier 10 of the present invention further includes reinforcement means at the end portion 30. In particular, an inside annular channel 35 is collectively defined and formed inside the carrier 20 by the peripheral wall 24, the annular end wall 31, and the annular flange 33. The reinforcement means for the end portion 30 is positioned within the annular channel 35 and, in particular, comprises a series of circumferentially spaced ribs 41 extending across the inside annular channel 35 along the end wall 31 to reinforce the end portion 30 of the carrier. The ribs 41 preferably extend radially across the channel 35 although the ribs 41 may be arranged to extend across the channel at an angle to the radius. The reinforcement means further comprises a circumferential raised rim 42 extending from the end wall 31 circumferentially around the inside annular channel 35 to intersect each of the ribs 41 and provide additional reinforcing strength to the end portion 30 of the carrier 20.

A particularly advantageous feature of the present invention is that each of the ribs 41 intersects the circumferential rim 42 to define a plurality of compartments 43. The compartments 43 have strengthened borders or edges so as to prevent an impact received at one compartment from causing damage to the end portion 30. More particularly, the compartmentalization of the end portion 30 serves to distribute or diffuse the resultant vector forces of an impact on the end portion 30. Additionally, should damage be incurred at the end portion 30, the compartmentalization helps to prevent it from spreading into adjacent compartments. Accordingly, the damage will be contained in as few compartments as possible. In accordance with the preferred embodiment, the circumferential rim 42 is generally centrally positioned so that the ribs 41 are generally bisected by the circumferential rim 42. However, the rim 42 may alternatively be positioned off-center so as to be closer in proximity to the peripheral wall 24 or the annular flange 33.

In an alternative embodiment of the present invention (not shown), two or more concentric circumferential rims may be provided alongside one another to further annularly compartmentalize the end portion 30. At the same time, while there are illustrated twelve radial ribs 41, if the end portion 30 is relatively large, additional ribs may be provided as desired so as to maintain relatively small compartments. Conversely, if the end portion 30 is formed of a relatively small radius, fewer ribs may be necessary.

The means for reinforcing, as should be apparent from the drawings, is sized to provide reinforcing strength without adding significantly to the weight of the carrier. In particular, the ribs 41 and the circumferential rim 42 extend heightwise from the annular end wall 31 generally toward the opposite end 23 of the carrier 20. The height dimension of the ribs and rim is comparable to the thicknesses of the peripheral wall 24 and the end wall 31. As such the ribs and rim do not add much weight or cost to the carrier. Further, the peaks or upper portions of the ribs 41 and the rim 42 define outer edges of the ribs and rim which lie in a substantially common plane with one another and wherein the plane is generally perpendicular to the axis of the tube. Moreover, the outer edges of the ribs and rim 41, 42 extend toward the opposite end 23 a distance significantly less than the annular flange 33.

The carrier 20 is preferably formed as an integral unit of plastic material by injection molding. As such it is lightweight, resilient and relatively inexpensive. The carrier preferably has thin or relatively thin walls, such as the peripheral wall 24, the annular end wall 31 and the flange 33, to minimize the amount of plastic used in forming the carrier 20 and to minimize the cost. It should be appreciated that the carrier 20 meets the low cost goals of the industry and at the same time further provides a reinforced end portion which resists damage and prevents the spread of any damage incurred. Minimizing damage to the carrier 20 also reduces the incidence of damaged yarn and the associated costs therewith.

In the drawings and specification there has been set forth preferred embodiments of the invention and although specific terms are employed, they are used in a generic and descriptive sense only and not for purposes of limitation.

That which is claimed is:

1. A lightweight yarn carrier adapted to be mounted on a winding machine and have yarn wound thereon to form a yarn package, said yarn carrier comprising:

a generally hollow tube having opposite ends and a relatively thin peripheral wall defining an outer surface for receiving yarn to be wound thereon;

a relatively thin annular end wall extending radially inwardly from one of said ends of said peripheral wall and terminating at an inner periphery;

an annular flange extending from said inner periphery of said end wall and extending toward the opposite end of said tube, said peripheral wall, said end wall, and said annular flange collectively defining an end portion of said carrier and an inside annular channel within said carrier formed therebetween;

a plurality of circumferentially spaced apart ribs extending across said inside annular channel to reinforce said end portion of said carrier; and at least one circumferential rim extending from said end wall and circumferentially around said inside annular channel and intersecting with each of said ribs to provide additional reinforcing strength for said end portion of said carrier such that said carrier is relatively lightweight with a reinforced end portion to withstand a substantial impact and avoid cracking and chipping.

2. The yarn carrier according to claim 1 wherein said ribs extend radially across said inside annular channel.

3. The yarn carrier according to claim 1 wherein said ribs are generally bisected by said circumferential rim.

4. The yarn carrier according to claim 1 wherein said flange extends toward said opposite end a distance greater than said ribs and said circumferential rim.

5. The yarn carrier according to claim 1 wherein said tube is in the shape of a truncated cone.

6. The yarn carrier according to claim 1 wherein said carrier is formed as an integral molded plastic.

7. The yarn carrier according to claim 1 wherein said ribs are spaced apart by a generally common distance around said inside annular channel.

8. A lightweight plastic yarn carrier adapted to be mounted on a winding machine and have yarn wound thereon to form a yarn package, said yarn carrier comprising:

a generally hollow conical tube having opposite ends and a relatively thin peripheral wall defining an outer surface for receiving yarn to be wound thereon;

an annular relatively thin end wall extending radially inwardly from one of said ends of said peripheral wall and terminating at an inner periphery;

an annular flange extending from said inner periphery of said end wall and extending toward the opposite end of said tube, said peripheral wall, said end wall, and said annular flange collectively defining an end portion of said carrier and an inside annular channel within said carrier formed therebetween;

a plurality of circumferentially spaced apart radial ribs extending radially across said inside annular channel along said end wall to reinforce said end portion of said carrier; and at least one circumferential rim extending from said end wall and circumferentially around said inside annular channel and intersecting each of said ribs to provide additional reinforcing strength for said end portion of said carrier such that said inside annular channel is divided into a plurality of compartments with strengthened borders, whereby said carrier is relatively lightweight with a reinforced end portion to withstand a substantial impact and to prevent any damage within one compartment to spread to adjacent compartments.

9. The yarn carrier according to claim 8 wherein said radial ribs are generally bisected by said circumferential rim.

10. The yarn carrier according to claim 8, wherein said inner flange extends toward said opposite end a distance greater than said radial ribs and said circumferential rim.

11. The yarn carrier according to claim 8 wherein said carrier is formed as an integral molded plastic unit.

12. The yarn carrier according to claim 9, wherein said plurality of radial ribs are at least twelve in number and said radial ribs are spaced apart by a generally common distance around said inside annular channel.

13. The yarn carrier according to claim 8 wherein said annular flange comprises a frusto-conical portion adjacent said end wall and a cylindrical inner end portion.

14. The yarn carrier according to claim 8 wherein said ribs and said rim extend from said end wall substantially the same distance and define outer edges which lie in a common plane extending perpendicular to the axis of the tube.

* * * * *